United States Patent [19]

Lindroos

[11] Patent Number: 4,558,733

[45] Date of Patent: Dec. 17, 1985

[54] HEAT EXCHANGER HAVING INTERMITTENTLY MOVABLE ROTATIONAL CLEANING ARMS

[75] Inventor: Runar Lindroos, Frövi, Sweden

[73] Assignee: Rilett Engergitjänst AB, Frövi, Sweden

[21] Appl. No.: 328,728

[22] Filed: Dec. 8, 1981

[30] Foreign Application Priority Data

Dec. 17, 1980 [SE] Sweden ..... 8008880

[51] Int. Cl.[4] ..... F28G 3/10; F28G 15/04; F28G 15/08

[52] U.S. Cl. ..... 165/94; 165/164; 165/76; 62/354

[58] Field of Search ..... 165/94, 95, 164, 76; 62/342, 343, 353, 354

[56] References Cited

U.S. PATENT DOCUMENTS

| | | | |
|---|---|---|---|
| 1,375,210 | 4/1921 | Clayton et al. | 165/94 |
| 1,678,070 | 7/1928 | Moore | 165/94 |
| 1,898,829 | 2/1933 | Greer | 165/94 |
| 2,460,499 | 2/1949 | Grace | 165/95 |
| 2,677,942 | 5/1954 | Schott et al. | 62/354 |
| 3,770,252 | 11/1973 | Gordini et al. | 165/94 |
| 4,059,047 | 11/1977 | Sollich | 62/354 |

FOREIGN PATENT DOCUMENTS

| | | | |
|---|---|---|---|
| 100699 | 1/1898 | Fed. Rep. of Germany | 165/94 |
| 24265 | 8/1950 | Finland | 165/94 |
| 529903 | 9/1921 | France | 165/164 |
| 14690 | of 1889 | United Kingdom | 165/164 |

*Primary Examiner*—William R. Cline
*Assistant Examiner*—John K. Ford
*Attorney, Agent, or Firm*—Burns, Doane, Swecker & Mathis

[57] ABSTRACT

A heat exchanger for exchanging heat between two media, one of which includes incrusting substances, includes a pair of end walls having a rotary shaft extending rotatably between the end walls. Between the end walls are located disc-shaped hollow members each of which has a central passage for the shaft. The members each have a through opening located on the side of the passage which opening is sealed from the interior of the member. Partitions extend within the hollow members between the peripheral inside of the member, in a place between an inlet and an outlet for the second medium, and the passage. Cleaning arms are non-rotatably connected to and extend radially from the shaft. In a heat exchanger in an assembled state, with an inlet for the first medium at one end wall and an outlet for the first medium at the other end wall, a cleaning arm is alternatively located between each member between the end walls. A cleaning arm is also located between each end wall and the member adjacent to each end wall. Rotation of the shaft moves the cleaning arm between adjacent members and, between an end wall and adjacent members.

4 Claims, 5 Drawing Figures

HEAT EXCHANGER HAVING INTERMITTENTLY MOVABLE ROTATIONAL CLEANING ARMS

FIELD OF THE INVENTION

This invention relates to an appartus for heat exchange between two media, one of which includes incrusting substances.

BACKGROUND AND SUMMARY OF THE PRESENT INVENTION

In order to increase the degree of effeciency of various processes, for example in the manufacture of sulphate pulp, it is necessary to preheat a thick liquor to high temperature prior to its combustion in a recovery boiler. The preheating is carried out by steam in a heat exhanger, which is a tube heat exchanger. Due to the high temperature, however, the tubes are incrusted with matter and impurities contained in the thick liquor.

The heat exchanger, therefore, must be opened at regular intervals to clean the tubes in order to maintain a somewhat uniform degree of efficiency. This cleaning work most often must be carried out in a hot and inconvenient atmosphere and it also adds extra costs to the process. In order to prevent interruption of the operation during the cleaning work, the heat exchanger can be doubled so that one heat exchanger is operative while the other one is being cleaned. Interruptions of the operation as well as extra heat exchangers increase the operation expenditures of the plant.

The present invention renders it possible to keep the hot surfaces wetted by the thick liquor clean of incrusting matter and thereby to maintain a uniform degree of efficiency of the heat exchanger without the process having to be stopped. It is, of course, possible to utilize the invention in other connections where there is a requirement of repeated cleaning of the heat exchanger surfaces.

BRIEF DESCRIPTION OF THE DRAWINGS

The invention is described in greater detail in the following by way of example and with reference to the accompanying drawings, in which.

DETAILED DESCRIPTION OF THE PREFERRED EMBODIMENT

Figure 1:
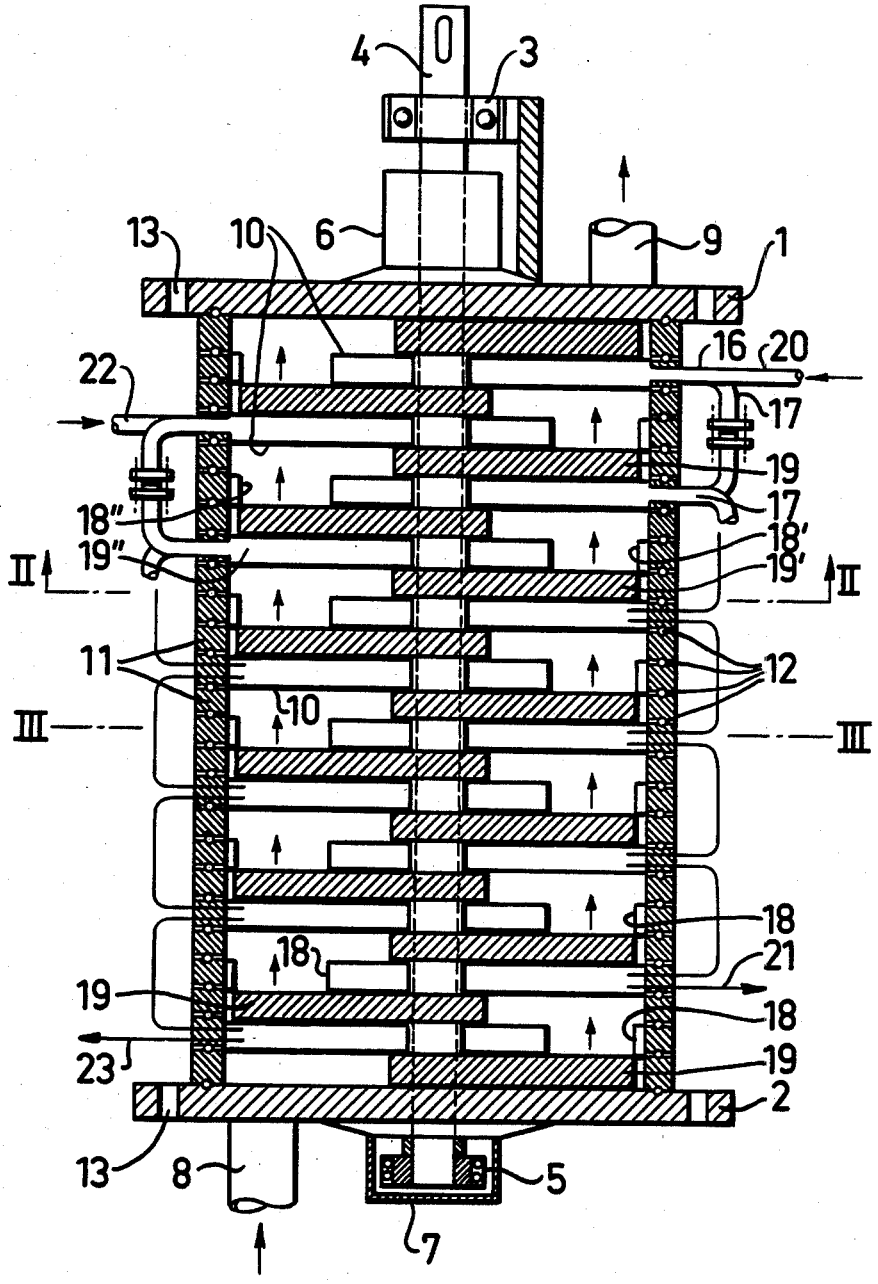
FIG. 1 is a section through an apparatus according to the invention.

The apparatus according to the invention has a first end wall 1 and a second wall 2. The first end wall 1 is provided with radial bearings 3 for a rotary shaft 4, which extends centrally through the first end wall 1, and which is supported by the second end wall 2 in an axial bearing 5. The shaft passage in the first end wall 1 is sealed by a mechanical sealing 6 and in the second end wall 2 by a casing 7 enclosing the bearing 5 and sealingly connected to the second end wall. The second end wall 2 has an inlet 8 for, in this case, thick liquor, and the first end wall 1 has an outlet 9 for the thick liquor.

Between the end walls 1,2, circular disc-shaped hollow members 10 and corresponding circular annular distance members 11 are alternately arranged and in such a manner, that a distance member 11 is located closest to each end wall. Sealing rings 12 are provided between the different parts, viz. end walls 1,2, members 10 and distance members 11. A heat exchanger in an assembled state, thus, has the form of a cylinder, and the parts are sealingly held together by bolts (not shown), which extend between the end walls 1,2 through suitable holes therein indicated by 13.

Figure 3:
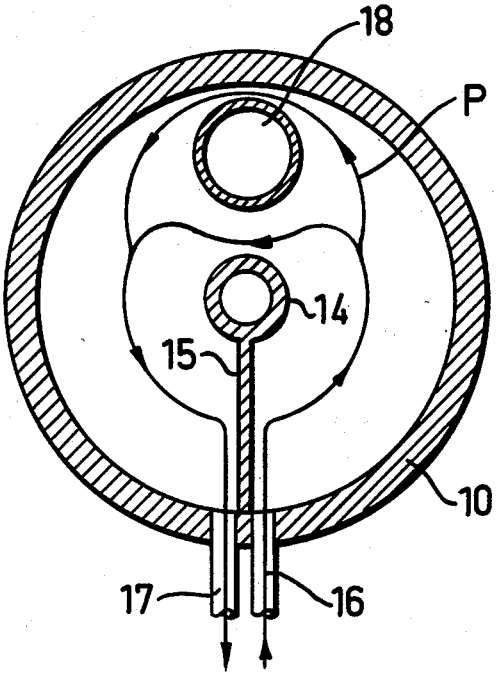
FIG. 3 is a section along the line III—III in FIG. 1.

A hollow member 10 is shown in greater detail by way of a section illustrated in FIG. 3. The shaft passage 14 is located in the center of the member which passage 14 seals against the interior of the member. A partition 15 extends between the shaft passage and the periphery of the member. An inlet 16 for steam is located, on one side of the partition 15 and an outlet 17 is located on the other side of the partition. Radially on the other side of the partition 15 a through opening 18 for thick liquor is located and sealed from the interior of the hollow member. Steam will flow in the member 10 as indicated schematically by the arrows P.

It is apparent from FIG. 1, that the disc-shaped members 10 alternately are turned through 180° relative to each other about the shaft 4, so that the thick liquor flowing in through the inlet 8 will flow in a zigzag path to the outlet 9.

In the space between two adjacent members 10 and, respectively, between an end wall 1,2 and a member 10 adjacent to each end wall, a non-rotatably connected cleaning arm 19 extends from the shaft 4 all the way to the inside of a distance ring 11. The arm 19 has a thickness or height adjusted to that of the distance ring, so that when the heat exchanger is in an assembled state the cleaning arm can move with only small clearance between the members 10 when the shaft 4 is rotating. As appears from FIG. 1, the arms 19 alternatingly are offset through 180° relative to each other.

It is apparent from FIG. 1, that the steam for heating the thick liquor is passed through the intake 20 into the inlet 16 of the uppermost member 10, passed about in the manner according to the arrows P in FIG. 3, and out through the outlet 17 of the member. From there the steam is directed via a connecting conduit into the third member where the steam circulates before being directed to the fifth member and so on. The steam in the form of condensate is discharged through the outlet 21. In the same way steam is passed via the intake 22 into the second member 10 and from there via a connecting conduit to the fourth member. Similarly, the steam so on and is discharged as condensate through the outlet 23. The intakes 20 and 22 preferably are connected to a steam collecting conduit in common for both (not shown), and the outlets 21 and 23 are connected to a common collecting conduit (not shown) for the condensate.

Figure 2:
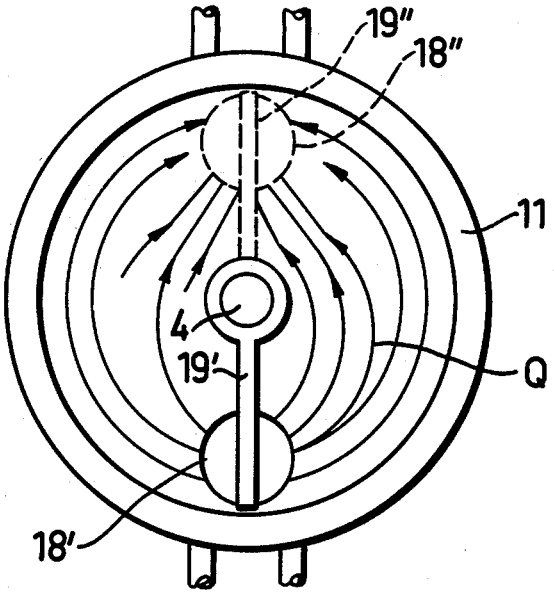
FIG. 2 is a section along the line II—II in FIG. 1.

The thick liquor to be heated by the steam is passed into the heat exchanger through the inlet 8 in the end wall 2 and flows countercurrent to the steam between the disc-shaped members 10 and out through the outlet 9. The cleaning arms 19, with reference to FIGS. 1 and 2, are located so as to extend transversely to an opening 18 of one of the adjacent members 10. Thus, the thick liquor flow between two members can be divided efficiently by the arm into two substantially uniform flows about the shaft 4. With reference to FIG. 2, the thick liquor flows on each side of the arm 19' inward through the opening 18', between the members and out through the opening 18" where the flow again is divided by the arm 19". The flow is indicated schematically by arrows Q.

Due to the heating in the heat exchanger, the thick liquor, as mentioned, has the tendency of forming precipitations and deposits, which "burn" onto the heat exchanger surfaces. By rotating the shaft 4 at suitable intervals by a motor (not shown) and thereby moving the arms 19 between the members 10, it is possible to keep the surfaces of the members continuously clean of incrusted deposits. Suitable controls ensure that the shaft always is stopped so that the cleaning arms 19 assume the position shown in FIG. 2 in relation to the openings 18.

By attaching the arms 19 to the shaft 4 by key joints or splines joints, it is possible to simply assemble and dismantle the heat exchanger by loosening the bolts (not shown) between the end walls 1 and 2, separating the distance rings and members from each other and drawing the arms off the shaft.

Figure 4:
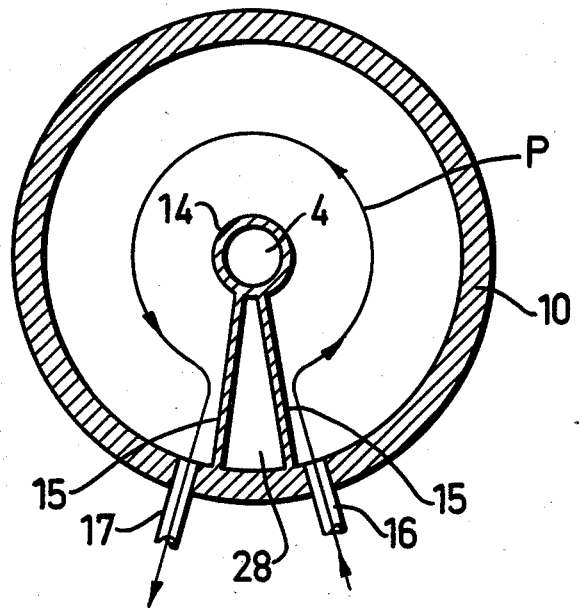
FIG. 4 is a section corresponding to that shown in FIG. 3, but at a slightly modified embodiment of the apparatus.

In FIG. 4 a different embodiment of the member 10 is shown. The opening 18 of the member described above has the configuration of a circle sector 28, and the sides of the opening simultaneously form the partition 15 referred to above. With the above-described structure, an embodiment is obtained which is somewhat simpler to manufacture.

Figure 5:
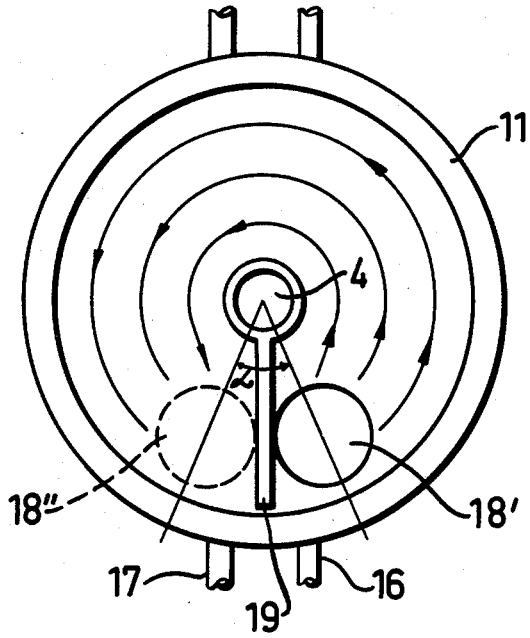
FIG. 5 is a section corresponding to that shown in FIG. 2 at still another modified embodiment.

It is not necessary within the scope of the invention to alternately offset the openings 18 and the arms 19 through 180° relative to each other. With reference to FIG. 5 which is a sectional view similar to FIG. 2, the cleaning arms 19 are directed in the same direction, whereby the opeings 18' and 18" are alternately offset only through a relatively small angle in relation to each other. With the arms 19 in an inoperative position, the arms are located between the openings of adjacent members, whereby the thick liquor is forced to flow substantially through half a revolution between two members.

Referring again to FIG. 2, it is possible to imagine the arms extended in the same direction, for example according to 19', whereby every second opening 18' is divided by an arm and every second opening 18" is left entirely free at non-operative shaft 4.

It should also be clear that the distance members 11 can be replaced by flanges arranged directly at the members 10, which flanges have a height corresponding to half the height of the distance member. Thereby the number of sealing surfaces and sealing rings 12 is reduced by about half.

What I claim is:

1. A heat exchanger for exchanging heat between a first medium and a second medium, one of the media including incrusting substances, comprising a pair of end walls, one of the end walls having an inlet for the first medium and the other end wall having an outlet for the first medium; a rotary shaft extending between the end walls; means for rotating the shaft so as to drive the shaft intermittently at preselected intervals of operation; a plurality of disc-shaped hollow members each having a central passage for the shaft and a through opening located on a side of the passage, the through opening being sealed from the interior of the member; said disc-shaped hollow members having an inlet and an outlet for the second medium; cleaning arms non-rotatably connected to and extending radially from the shaft, a cleaning arm and a member alternating between the first and second end walls such that each of the cleaning arms by rotation of the shaft moves either between adjacent members or between an end wall and a member adjacent to the respective end wall wherein the openings of two of said adjacent members are offset by 180° about the shaft in relation to each other; and, the cleaning arms in an inoperative state extending substantially centrally over the opening of the respective member whereby an area of the opening of substantially equal size is located on each side of the cleaning arm.

2. The heat exchanger as defined in claim 1, wherein partitions are located within each of the members and extend between the passage and an inner periphery of the respective member, said partition being connected to the inner periphery of the respective member between the inlet and the outlet.

3. A heat echanger as defined in claim 1, wherein a distance ring is located between two adjacent disc-shaped members, annular sealings being located between the members and the distance rings and between said rings and the end walls, and bolt connections are arranged between the end walls so as to press together the disc-shaped members, the intermediate distance rings and the sealings.

4. A heat echanger as defined in claim 1, wherein the cleaning arms are non-rotatably attached and axially movable with respect to the shaft by key or splines joints.

* * * * *